US005698359A

United States Patent [19]

Yanus et al.

[11] Patent Number: 5,698,359

[45] Date of Patent: Dec. 16, 1997

[54] METHOD OF MAKING A HIGH SENSITIVITY VISIBLE AND INFRARED PHOTORECEPTOR

[75] Inventors: John F. Yanus, Webster; Damodar M. Pai, Fairport, both of N.Y.; Dasarao K. Murti; Cheng-Kuo Hsiao, both of Mississauga, Canada; Paul J. Defeo, Sodus Point, N.Y.

[73] Assignee: Xerox Corporation, Stamford, Conn.

[21] Appl. No.: 782,236

[22] Filed: Jan. 13, 1997

[51] Int. Cl.[6] ..... G03G 5/047

[52] U.S. Cl. ..... 430/132; 430/59

[58] Field of Search ..... 430/59, 132

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,818,650 | 4/1989 | Limburg et al. | 430/56 |
| 4,935,487 | 6/1990 | Yanus et al. | 528/203 |
| 4,956,440 | 9/1990 | Limburg et al. | 528/99 |
| 5,028,687 | 7/1991 | Yanus et al. | 528/203 |
| 5,030,532 | 7/1991 | Limburg et al. | 430/56 |
| 5,283,143 | 2/1994 | Yanus et al. | 430/59 |
| 5,302,479 | 4/1994 | Daimon et al. | 430/78 |
| 5,310,613 | 5/1994 | Pai et al. | 430/59 |
| 5,409,792 | 4/1995 | Yanus et al. | 430/59 |
| 5,521,306 | 5/1996 | Burt et al. | 540/141 |
| 5,571,649 | 11/1996 | Mishra et al. | 430/59 |

*Primary Examiner*—Roland Martin

[57] ABSTRACT

A process for fabricating an electrophotographic imaging member including providing a supporting substrate, forming a charge generating layer on the substrate, applying a coating composition to the charge generating layer, the coating composition including a film forming charge transporting polymer dissolved in methylene chloride and a solvent selected from the group consisting of 1,2 dichloroethane, 1,1,2 trichloroethane or mixtures thereof, the charge transporting polymer having a backbone comprising active arylamine moieties along which charge is transported, and drying the coating to form a charge transporting layer.

11 Claims, No Drawings

METHOD OF MAKING A HIGH SENSITIVITY VISIBLE AND INFRARED PHOTORECEPTOR

BACKGROUND OF THE INVENTION

This invention relates in general to electrophotographic imaging members and more specifically, to imaging members comprising hydroxygallium phthalocyanine and charge transporting polymer components.

One common type of electrophotographic imaging member or photoreceptor is a multilayered device that comprises a conductive layer, an optional charge blocking layer, an adhesive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that when high concentrations of active aromatic diamine small molecule charge transport compound are dissolved or molecularly dispersed in a film forming binder, the small molecules tend to crystallize with time under conditions such as higher machine operating temperatures, mechanical stress or exposure to chemical vapors. Such crystallization can cause undesirable changes in the electro-optical properties, such as residual potential build-up which can cause cycle-up. It has been found that these same photoreceptors containing an active aromatic diamine small molecule charge transport compound dissolved or molecularly dispersed in a film forming binder become unstable when employed with liquid development systems. These photoreceptors suffer from cracking, crazing, extraction, phase separation and crystallization of charge transporting active compounds by contact with the organic carrier fluid in a machine employing a liquid development system. A commonly employed organic carrier fluid in liquid development systems is an isoparaffinic hydrocarbon, for example, Isopar® available from Exxon Chemicals International, Inc. The leaching and crystallization of charge transporting active compounds markedly degrades the mechanical integrity and electro-optical performance of the photoreceptors. More specifically, the organic carrier fluid of a liquid developer leaches out activating small molecules, such as the arylamine containing compounds typically used in the charge transport layers. Representative of this class of materials are: N,N'-diphenyl-N,N'-bis(3-methylphenyl)-[1,1'-biphenyl]-4,4'-diamine; bis-(4-diethylamino-2-methylphenyl)-phenylmethane; 2,5-bis-(4'-diethylamino phenyl)-1,3,4-oxadiazole; 1-phenyl-3-(4'-diethylaminostyryl)-5-(4"-diethylaminophenyl)pyrazoline; 1,1 -bis-(4-(di-N,N'-p-methyl phenyl)-aminophenyl) cyclohexane;4-diethylaminobenzaldehyde-1,1-diphenylhydrazone; 1,1-diphenyl-2(p-N,N-diphenylamino phenyl)-ethylene. The leaching process results in crystallization of the charge transporting activating small molecules, such as the aforementioned arylamine compounds, onto the photoreceptor surface and subsequent migration of the arylamine into the liquid developer ink. In addition, the ink vehicle, typically a $C_{10}$–$C_{14}$ branched hydrocarbon, induces the formation of cracks and crazes in the photoreceptor leading to the onset of copy defects and shortened photoreceptor life. Sufficient degradation can occur in less than eight hours of use making these photoreceptors unsuitable for use in machines employing liquid developers.

Another type of charge transport layer has been developed which utilizes a charge transporting polymer. This type of charge transport polymer includes materials such as poly N-vinyl carbazole, polysilylenes, and others including those described in U.S. Pat. Nos. 4,806,443, 4,806,444, 4,818,650, 4,935,487, and 4,956,440. Other charge transporting materials include polymeric arylamine compounds and related polymers described in U.S. Pat. Nos. 4,801,517, 4,806,444, 4,818,650, 4,806,443, 5,030,532, the disclosures of which are incorporated herein by reference in their entirety. Some polymeric charge transporting materials have relatively low charge carrier mobilities. Mechanical properties of these pendant type polymers, such as poly N-vinyl carbazole and polystyryl anthracene, is less than adequate for photoreceptor belt fabrication and operation. Moreover, charge transporting polymers having high concentrations of charge transporting moieties in the polymer chain can be very costly. Further, the mechanical properties of charge transporting polymers such as wearability, hardness and craze resistance are reduced when the relative concentration of charge transporting moieties in the chain is increased.

Phthalocyanines have been employed as photogenerating materials for use in both visible and infrared radiation exposure machines. Infrared sensitivity is a requirement if semiconductor lasers are employed as the exposure source. The absorption spectrum and photosensitivity depend on the central metal atom. Many metal phthalocyanines have been reported. These include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. Some of these phthalocyanines exist in many crystal forms. Even with the same central metal atom, the absorption spectrum and sensitivity may depend on crystal structure and morphology.

The photogenerating layer contains a bichrornophoric photogenerating compound, for example a phthalocyanine pigment compound, or a mixture of two or more phthalocyanine pigment compounds. Generally, this layer has a thickness of from about 0.05 micrometer to about 10 micrometers or more, and preferably has a thickness of from about 0.1 micrometer to about 3 micrometers. The thickness of this layer, however, is dependent primarily upon the concentration of photogenerating material in the layer, which may generally vary from about 5 to 100 weight percent. When the photogenerating material is present in a binder material, the binder preferably contains from about 30 to about 95 percent by weight of the photogenerating material, and preferably contains about 80 percent by weight of the photogenerating material. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

The sensitivity of a layered device depends on several factors: (1) the fraction of the light absorbed, (2) the efficiency of photogeneration within the pigment crystals, (3) the efficiency of injection of photogenerated holes into the transport layer and (4) the distance the injected carrier travels in the transport layer between the exposure and development steps. The fraction of the light absorbed can be maximized by the employment of an adequate concentration of pigment in the generator layer and increasing the thickness of the generator layer. The distance the carrier travels in the transport layers can be optimized by the selection of the transporting material and increasing the concentration of the charge transporting active molecules in the case of transport layers containing a dispersion of transport active molecules in a non-transporting inactive binder. However the efficiency of photogeneration and injection can be interactive in that both processes depend on both the pigment and the transport material selected. There are at least two reasons for this interactive dependence. The photogeneration efficiency achievable with some pigments depends upon the presence of the transporting material on the surface of the pigment. Devices fabricated with these pigments may be sensitive with transport layers employing active molecules dispersed in an inactive binder material, but may be very much less sensitive when employed in conjunction with transport layers consisting of charge transporting polymers. This dependence arises in embodiments where the transport layer consists of active molecules dispersed in an inactive binder (herein termed small molecule transport layer) and the active molecules penetrate the generator layer during the fabrication of the transport layer. In other words, due to the diffusion of the small molecules into the generator layer, the demarcation between the generator layer and transport layer is not abrupt. This is not the case when the transport layer consists of a charge transporting polymer. Therefore there is no certainty that a pigment that seems sensitive in a device employing a small molecule transport layer will have good sensitivity when employed in conjunction with a charge transporting polymer layer. Interactive dependence of injection efficiency can also be related to ionization potential matching of the constituent charge transport molecules and the charge generating pigment or pigments. For layered devices employing hole photogeneration and transport, the ionization potential of the charge transport layer material ($IP_{CTL}$) must be smaller than the ionization potential of the charge generating pigment ($IP_{CGP}$) to ensure maximum injection efficiency, that is, $IP_{CTL}<IP_{CGP}$. Also, because of the abrupt nature of the demarcation between the generator and transport layers when the transport layer is fabricated from a charge transporting polymer, there is a tendency for some of the charges generated in the generator layer to be trapped at the interface between the generator layer and transport layer. This trapping may result from the way the polymeric chains of the transport layer spread in the interface region. If the transport layer molecular chains form small coils, there might be regions devoid of the charge transporting moieties that are part and parcel of the polymer chains. The nature of the structure of the polymeric transport layer at an interface is not well understood and is a field of active study at the present time. The structure of the transport layer and the way it spreads may depend on the end groups, which in many polymers is not under control of the synthetic chemist. The structure of the polymeric chains at the interface may also depend on the nature of the surface on which the polymeric transport layer is coated. In the case of multilayer organic photoconductors, the structure of the transport layer may depend on the properties of the generator layer surface. One would assume that for efficient charge transfer, the polymer chain should open up into as large a coil as possible. The charge trapping at the interface during injection from the generator layer into the transport layer results in loss of sensitivity and a residual potential in an electrophotographic imaging cycle comprising charge-expose and erase steps. During continuous charge-expose-erase cycles required in a multicopy or print mode, the residual voltage due to trapping at the interface keeps increasing with cycles resulting in a problem known as cycle-up. When the cycle-up reaches a few volts, the print quality is very adversely affected.

Thus, in imaging systems utilizing multilayered photoreceptors containing generator layers employing some pigments and charge transporting polymers in the transport layers, loss of sensitivity may result from the active transport species not physically penetrating the generator layer. Reduced sensitivity can reduce the practical value of multilayered photoreceptors for use in high speed electrophotographic copiers, duplicators and printers. Also, charge trapping at the interface between a charge transport layer and a charge generating layer due to non-optimum nature of the charge transporting polymeric structure at the interface results in a residual potential and cycle-up making the device impractical for use in electrophotography.

INFORMATION DISCLOSURE STATEMENT

U.S. Pat. No. 4,806,443 to Yanus et al., issued Feb. 21, 1989—An electrophotographic imaging member and an electrophotographic process are disclosed in which the imaging member comprises a polymeric arylamine compound represented by a specific formula.

U.S. Pat. No. 4,818,650 to Limburg et al, issued Apr. 4, 1989—An electrostatographic imaging member and electrostatographic imaging process are disclosed in which the imaging member comprises a polymeric arylamine compound represented by a specific formula.

U.S. Pat. No. 4,806,444 to Yanus et al., issued Feb. 21, 1989—An electrostatographic imaging member and electrostatographic imaging process are disclosed in which the imaging member comprises a polymeric arylamine compound represented by a specific formula.

U.S. Pat. No. 4,935,487 to Yanus et al., issued Jun. 19, 1990—A polymeric arylamine having a specific formula is disclosed.

U.S. Pat. No. 4,956,440 to Limburg et al., issued Sep. 11, 1990—Polymeric tertiary arylamine compounds of the phenoxy resin type are disclosed for electrophotographic imaging.

U.S. Pat. No. 4,801,517 to Frechet et al., issued Jan. 31, 1989—An electrostatographic imaging member and electrostatographic process are disclosed in which the imaging member comprises a polymeric arylamine compound having a specific formula.

U.S. Pat. No. 5,028,687 to Yanus et al., issued Jul. 2, 1991—A polymeric arylamine having a specific formula is disclosed. The material is useful in fabricating a charge transport layer of photosensitive members.

U.S. Pat. No. 5,030,532 to Liraburg et al, issued Jul. 9, 1991—A polymeric arylamine having a specific formula is disclosed. The material is useful in fabricating a charge transport layer of photosensitive members.

U.S. Pat. No. 5,283,143 to Yanus et al., issued Feb. 1, 1994—An arylamine terpolymers with $CF_3$ substituted moieties is disclosed.

U.S. Pat. No. 5,310,613 to Pai et al., issued May 10, 1994—An electrophotographic imaging member including a charge generating layer containing oxytitanium phthalocyanine polymorph and a charge transport layer containing a film forming charge transporting polymer including charge transporting moieties in the backbone of the film forming charge transporting polymer, for example polysilylenes and polyarylamine derivatives.

U.S. Pat. No. 5,409,792 to Yanus et al., issued Apr. 25, 1995—An electrophotographic imaging member including a charge generating layer and a charge transport layer comprising a charge transporting small molecule dissolved or molecularly dispersed in a film forming charge transporting polymer comprising charge transporting moieties in the backbone of the film forming charge transporting polymer, the charge transporting moieties having a structure unlike the structure of the charge transporting molecule.

U.S. Pat. No. 5,302,479 to Damon et al. issued Apr. 12, 1994—Crystals of hydroxygallium phthalocyanine, a method of preparing the crystals, a photoconductive material containing the crystals and an electrophotographic photoreceptor having the material are disclosed.

U.S. Pat. No. 5,521,306 to Burt et al. issued on May 28, 1996—A process for preparation of Type V hydroxygallium phthalocyanine is disclosed comprising the in situ formation of an alkoxy-bridged gallium phthalocyanine dimer, hydrolyzing the alkoxy-bridged gallium phthalocyanine dimer to hydroxygallium phthalocyanine, and subsequently converting the hydroxygallium phthalocyanine product obtained to Type V hydroxygallium phthalocyanine.

SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids crystallization when operated in an environment employing liquid ink development.

It is still another object of the present invention to provide an electrophotographic imaging member exhibiting improved imaging operation during extended image cycling.

It is yet another object of the present invention to provide an electrophotographic imaging member which can be coated employing a variety of solvents.

It is still another object of this present invention to provide an electrophotographic imaging member with very high sensitivities in both the visible and infrared regions of the electromagnetic spectrum.

It is still another object of this invention to provide an electrophotographic imaging member with no charge trapping at the interface between the generator layer and the polymeric charge transport layer.

The foregoing objects and others are accomplished in accordance with this invention by providing a process for fabricating an electrophotographic imaging member comprising providing a supporting substrate, forming a charge generating layer on said substrate comprising hydroxygallium phthalocyanine pigment particles dispersed in a film forming binder, forming on the charge generating layer a coating comprising a charge transporting polymer dissolved in methylene chloride and a solvent selected from the group consisting of 1,2 dichloroethane, 1,1,2 trichloroethane or mixtures thereof, the charge transporting polymer having a backbone comprising active arylamine moieties along which charge is transported, and drying the coating to form a charge transporting layer. The imaging member prepared by this fabrication process may be employed in an electrophotographic imaging process.

It has been found that with charge transport polymers containing arylamine moieties in the backbone of the polymer, the trapping characteristics at the interface between the generating and transport layers depends on the nature of the generating layer and the solvent employed to form the transport layer coating. Although all batches of a transport layer polymer, when applied as a coating using methylene chloride as the solvent, did not show any interface trapping when coated onto generator layers containing vanadyl phthalocyanine dispersed in a polyester resin (Vitel PE100, available from Goodyear Tire and Rubber Co). trapping was seen with some batches of the polymer when applied as a coating using methylene chloride as the solvent on generator layers containing hydroxygallium phthalocyanine dispersed in a block copolymer of styrene/4-vinyl pyridine. The severity of trapping at the interface when coated on generator layers containing hydroxygallium phthalocyanine dispersed in a block copolymer of styrene/4-vinyl pyridine varied from batch to batch of the transport polymer and was not observed with some batches. Not to be limited by any theory, it is believed that the structure of the transport polymer was not optimum when applied as a coating using methylene chloride as the solvent on generator layers containing hydroxygallium phthalocyanine dispersed in a block copolymer of styrene/4-vinyl pyridine. However, no interface trapping was observed when a transport layer containing arylamine small molecule dispersed in polycarbonate was coated employing methylene chloride on either vanadyl phthalocyanine dispersed in a polyester resin (Vitel PE100) or hydroxygallium phthalocyanine dispersed in a block copolymer of styrene/4vinyl pyridine.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which may be rigid or flexible. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 Angstrom units to about 750 Angstrom units, and more preferably from about 100 Angstrom units to about 200 Angstrom units for an optimum combination of electrical conductivity, flexibility and light transmission.

The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square centimeter.

After formation of an electrically conductive surface, an optional charge blocking layer or barrier layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage. A charge blocking layer is normally not employed when the charge transport layer is located between the substrate and the charge generating layer.

An optional adhesive layer may applied to the hole blocking layer or conductive layer. Any suitable adhesive layer well known in the art may be utilized. Typical adhesive layer materials include, for example, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

The pigment in the generator layer comprises mainly polymorphs of hydroxygallium phthalocyanines or structural derivative thereof, the structure being represented by the following formula:

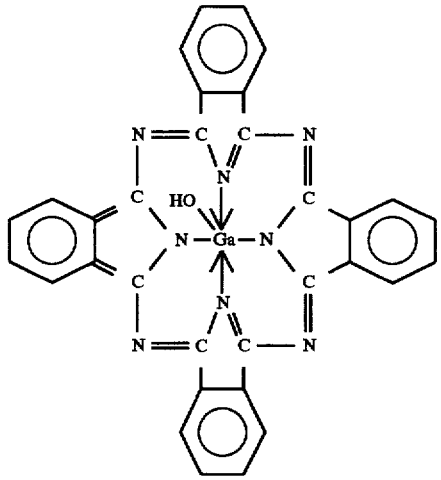

A variety of techniques may be used to prepare hydroxygallium phthalocyanine compounds and derivatives thereof as described, for example in: U.S. Pat. No. 5,302,479, U.S. Pat. No. 5,521,306, the disclosures of which are incorporated herein by reference in their entirety. Particularly preferred hydroxygallium phthalocyanine polymorphs, include for example, Type V. The Type V hydroxygallium phthalocyanine polymorph has an X-ray diffraction pattern with major peaks at Bragg angles of: 7.4, 9.8, 12.4, 12.9, 16.2, 18.4, 21.9, 23.9, 25.0, 28.1 and the highest peak at 7.4 degrees $2\Theta$ (2 theta±0.2°).

Multi-photogenerating layer compositions may be utilized where a photoconductive layer beneficially modifies the properties of the photogenerating layer. Examples of this type of configuration are described in U.S. Pat. No. 4,415,639, the disclosure of this patent being incorporated herein by reference in its entirety.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. Other organic polymeric film forming binders include charge transporting polymers for example polyether carbonates as disclosed for example in U.S. Pat. Nos. 4,801,517, 4,806,443, 4,806,444, 4,818,650 and 5,030,532 and polysilylenes as disclosed for example in U.S. Pat. Nos. 4,839,451 and 4,618,551, the disclosures of which are incorporated herein by reference in their entirety. These charge transporting polymers are also described in detail below with reference to the charge transport layer.

A particularly preferred binder is a polystyrene/polyvinyl pyridine block copolymer represented by the formula:

$$[\text{polystyrene}]_m/[\text{polyvinyl pyridine}]_n$$

wherein, for example, polyvinyl pyridine is formed from 4-vinyl pyridine and n can be a number between about 7 and about 50 and wherein polystyrene can be formed from styrene and m is a number between about 70 and about 800, with compositional ratios of the 4-vinyl-pyridine to styrene in the range of between about 5/95 and about 30/70 and more preferably in the range between about 8/92 and about 20/80, based on the the total weight of the two components. Examples of pyridine moieties for the copolymers include poly(2-vinylpyridine), poly(4-vinylpyridine) and the like. Examples of polystyrene moieties include polystyrene, poly [p-(dimethylamino methyl)styrene], and the like. Polystyrene/polyvinyl pyridine ($A_n$–$B_m$) block copolymers and processes for synthesizing them are described in U.S. Pat. Nos. 5,384,222 and 5,384,223. the disclosures of these two patents are incorporated herein by reference in their entirety. The above polystyrene/polyvinyl pyridine block copolymer formula includes copolymers of polystyrene and polyvinyl pyridines such as polystyrene/poly-4-vinyl pyridine with, for example, a $M_w$ of between about 7,000 and about 80,000 and more preferably between about 10,500 and about 40,000, and a $M_n$ of between about 5,500 and about 60,200, and preferably between about 8,000 and about 22,800, and wherein the percentage, based on weight of vinyl pyridine is between about 5 and about 55 and preferably between about 9 and about 20. The remaining percentage being made up of a polystyrene block.

The photogenerating composition or pigment is present in the resinous binder composition in various amounts, generally, however, from about 10 percent by volume to about 90 percent by volume of the photogenerating pigment is dispersed in about 90 percent by volume to about 10 percent by volume of the film forming binder, and preferably from about 20 percent by volume to about 40 percent by volume of the photogenerating pigment is dispersed in about 80 percent by volume to about 60 percent by volume of the binder composition.

The photogenerating layer containing photoconductive pigments and the film forming binder material generally ranges in thickness of from about 0.1 micrometer to about 5 micrometers, and preferably has a thickness of from about 0.2 micrometer to about 1 micrometer. The photogenerating layer thickness is related to binder content. Higher binder content compositions generally require thicker layers for photogeneration. Thicknesses outside these ranges can be selected providing the objectives of the present invention are achieved.

While there is no particular restriction on the mixing ratio between the hydroxygallium phthalocyanine and the binder polymer, the binder polymer is generally used in an amount from 5 to 500 parts by weight, preferably, from 10 to 50 parts by weight based on 100 parts by weight of the hydroxygallium phthalocyanine compound.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infrared radiation drying, air drying and the like.

Any suitable charge transporting polymer having active moieties incorporated in the backbone of the polymer may be utilized in the charge transporting layer of this invention. During electrophotographic imaging, the charge is transported through these active moieties in the backbone of the polymer. This charge transporting polymer should be soluble in methylene chloride and a solvent selected from the group consisting of 1,2 dichloroethane, 1,1,2 trichloroethane or mixtures thereof. A class of such charge transporting polymers are condensation polymers containing arylamine compounds incorporated in the backbone. These electrically active charge transporting polymeric materials should be capable of supporting the injection of photogenerated holes from the charge generation material and capable of allowing the transport of these holes therethrough. In this class of of polymers, charges are transported through the backbone of the polymer. Particularly preferred charge transport polymers are poly(arylamine carbonate) compounds. The expression "charge transporting moieties" of the film forming charge transporting polymer as employed herein is defined as one of the "active" units or segments that support charge transport. Typical charge transporting polymers of this class of condensation polymers containing arylamine compounds incorporated in the back bone include arylamine compounds represented by the formula:

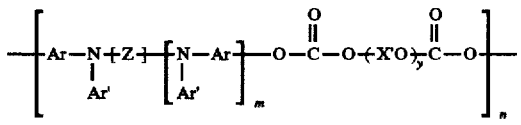

wherein n is between about 5 and about 5,000,

Z is selected from the group consisting of:

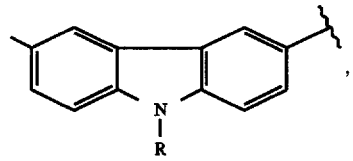

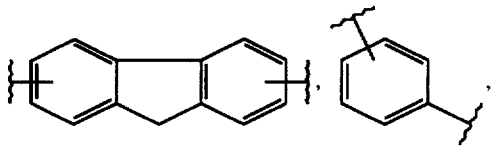

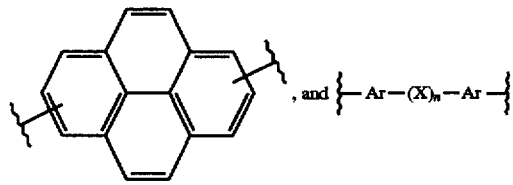

n is 0 or 1, Ar is selected from the group consisting of:

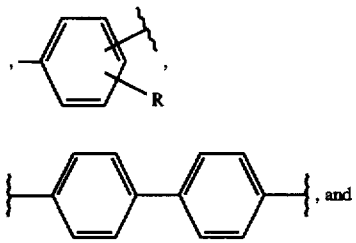

-continued

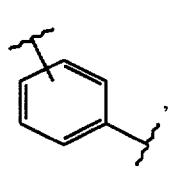

R is an alkylene radical selected from the group consisting of alkylene and iso-alkylene groups containing 2 to 10 carbon atoms, Ar' is selected from the group consisting of:

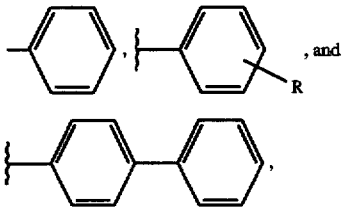

X is selected from the group consisting of:

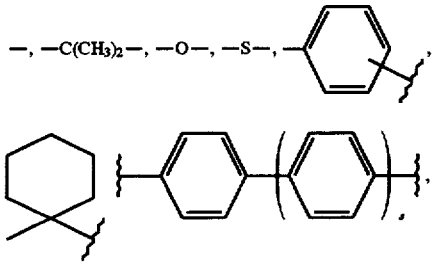

-continued

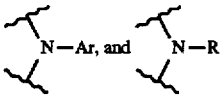

s is 0, 1 or 2, and X' is an alkyl radical selected from the group consisting of alkyl and iso-alkyl groups containing 2 to 10 carbon atoms.

A typical charge transporting polymer represented by the above formula is:

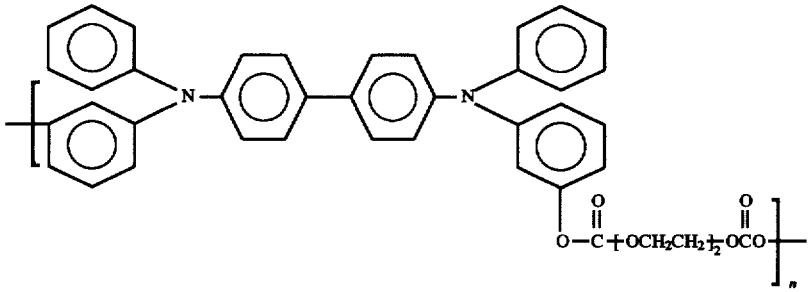

wherein the value of n is between about 10 and about 1,000. This and other charge transporting polymers represented by the above generic formula are described in U.S. Pat. No. 4,806,443, the entire disclosure thereof being incorporated herein by reference.

Other typical charge transporting polymers include arylamine compounds represented by the formula:

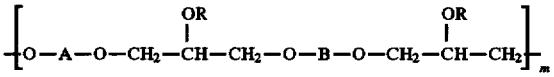

wherein:

R is selected from the group consisting of —H, —$CH_3$, and —$C_2H_5$;

m is between about 4 and about 1,000; and

A is selected from the group consisting of an arylamine group represented by the formula:

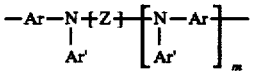

wherein:

m' is 0 or 1,

Z is selected from the group consisting of:

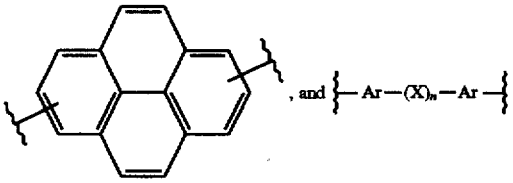

-continued

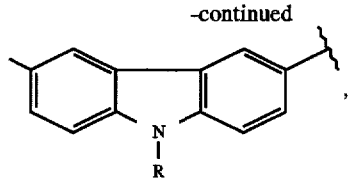

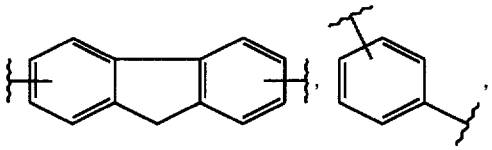

wherein:

n is 0 or 1,

Ar is selected from the group consisting of:

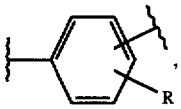

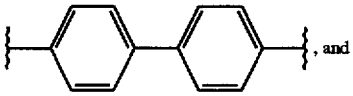

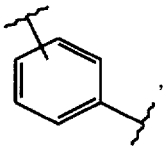

wherein:

R' is selected from the group consisting of —$CH_3$, —$C_2H_5$, —$C_3H_7$, and —$C_4H_9$, Ar' is selected from the group consisting of:

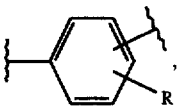

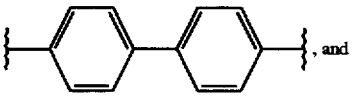

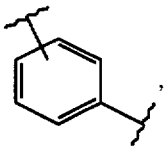

X is selected from the group consisting of:

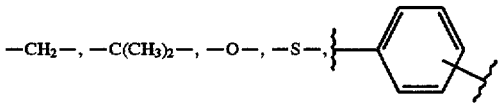

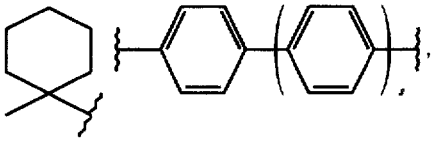

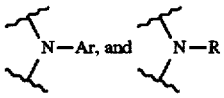

B is selected from the group consisting of:

the arylamine group as defined for A, and $$—Ar—(V)_n—Ar—$$

wherein

Ar is as defined above, and V is selected from the group consisting of:

$$—CH_2—,\ —C(CH_3)_2—,\ —O—,\ —S—,$$

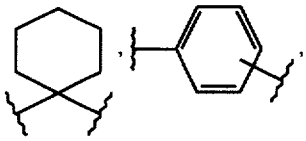

and n is 0 or 1.

Specific examples include:

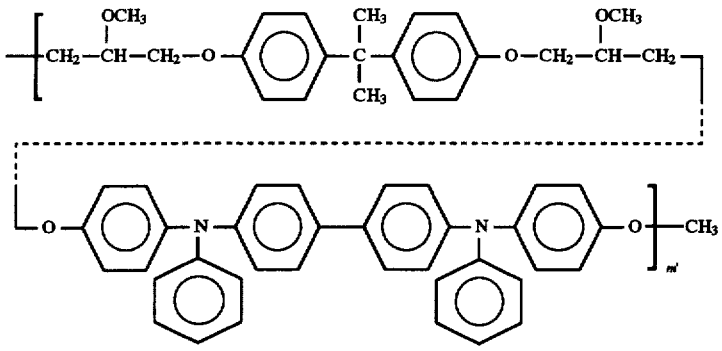

where the value of m' was between about 18 and about 19 and where the value of m" was between about 4 and about 5. These and other charge transporting polymers represented by the above generic formula are described in U.S. Pat. No. 4,818,650 and U.S. Pat. No. 4,956,440, the entire disclosures thereof being incorporated herein by reference.

Examples of still other typical charge transporting polymers include:

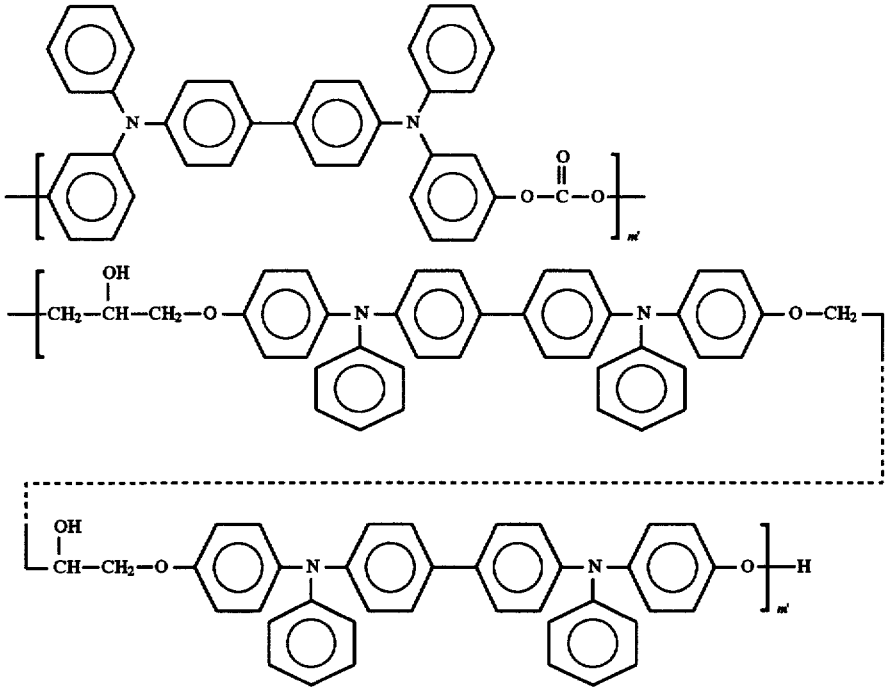

wherein the value of m' was between about 10 and about 50. These and other related charge transporting polymers are described in U.S. Pat. Nos. 4,806,444 and 4,956,487, the entire disclosures thereof being incorporated herein by reference.

Other examples of typical charge transporting polymers are:

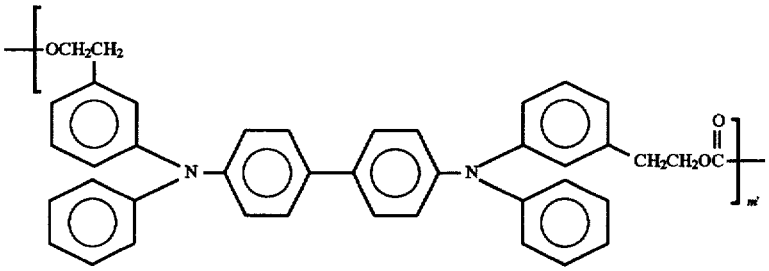

wherein m' is between about 10 and about 10,000 and

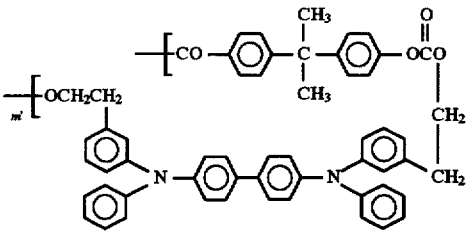

wherein m' is between about 10 and about 1,000. Related charge transporting polymers include copoly [3,3'bis (hydroxyethyl)triphenylamine/bisphenol A]carbonate, copoly [3,3'bis(hydroxyethyl)tetraphenylbezidine/bisphenol A]carbonate, poly[3,3' bis(hydroxyethyl) tetraphenylbenzidine]carbonate, poly [3,3'bis(hydroxyethyl) triphenylamine]carbonate, and the like. These charge transporting polymers are described in U.S. Pat. No. 4,401,517, the entire disclosure thereof being incorporated herein by reference.

Further examples of typical charge transporting polymers include:

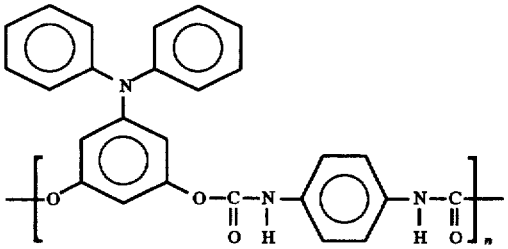

where n is between about 5 and about 5,000;

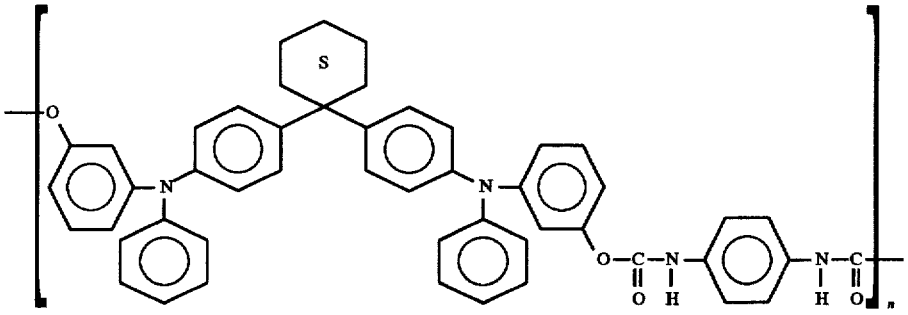

where n represents a number sufficient to achieve a weight average molecular weight of between about 20,000 and about 500,000;

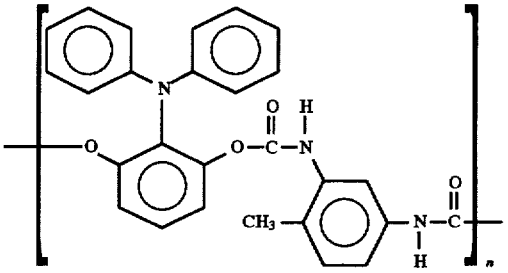

where n represents a number sufficient to achieve a weight average molecular weight of between about 20,000 and about 500,000; and

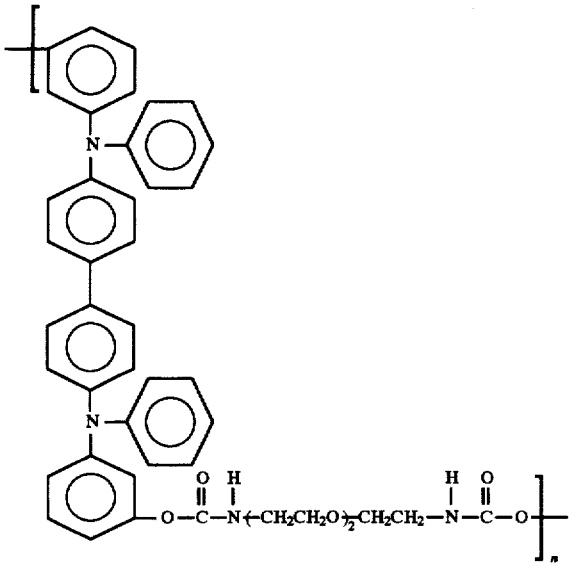

where n represents a number sufficient to achieve a weight average molecular weight of between about 20,000 and about 500,000. These and other related charge transporting polymers are described in U.S. Pat. No. 5,030,532 issued Jul. 9, 1991, the entire disclosure thereof being incorporated herein by reference.

Still other typical charge transporting polymers of the first class of condensation polymers containing arylamine compounds incorporated in the back bone include arylamine compounds are disclosed in U.S. Pat. No. 5,283,143, the entire disclosure thereof being incorporated herein by reference. This material is useful in fabricating a charge transport layer of photosensitive members and comprises a polyarylamine polymer represented by the following formula:

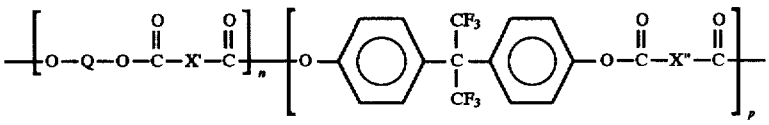

wherein:

n is between about 5 and about 5,000 p is between about 5 and about 5,000

X' and X" are independently selected from a group having bifunctional linkages, and Q is a divalent group derived from certain hydroxy terminated arylamine reactants.

Another typical charge transporting polymer of the first class of condensation polymers containing arylamine compounds incorporated in the back bone are disclosed in U.S. Pat. No. 5,356,743, the entire disclosure thereof being incorporated herein by reference. This material is also useful in fabricating a charge transport layer of photosensitive members and comprises a polyarylamine polymer represented by the following formula:

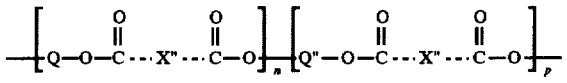

wherein:

n is between about 5 and about 5,000 p is between about 0 and about 5,000

X' and X" are independently selected from a group having bifunctional linkages,

Q is a divalent group derived from certain hydroxy terminated arylamine reactants, and Q' is a divalent group derived from a hydroxy terminated group.

Another typical charge transporting polymer of the first class of condensation polymers containing arylamine compounds incorporated in the back bone is disclosed in U.S. Pat. No. 5,030,532 issued Jul. 9, 1991 and is represented by the formula:

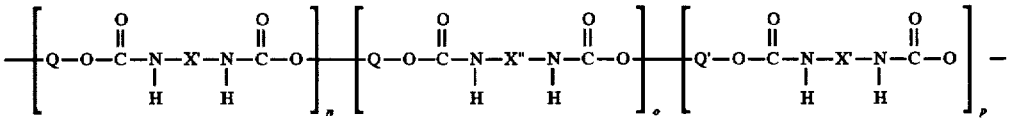

wherein:

n is between about 5 and about 5,000, or 0 if p>0, o is between about 0 and about 5,000, or is 0 if p>0 or n=0, p is between about 2and about 100, or is 0 if n>0, X' and X" are independently selected from a group having bifunctional linkages, Q is a divalent group derived from certain hydroxy terminated arylamine reactants, Q' is a divalent group derived from a hydroxy terminated polyarylamine containing the group defined for Q and having a weight average molecular weight between about 1000 and about 80,000, and the weight average molecular weight of the polyarylamine polymer is between about 10,000 and about 1,000,000.

The polymer transport layer can have plasticizing or antioxidant additives of as much as 10 weight per cent by weight of the total layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the hole transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The principal solvent for coating the polymeric transport layers is methylene chloride. Unexpectedly, the charge trapping at the interface between the charge generator layer and the charge transport layer observed with the devices obtained when some lots of these polymers is eliminated and the performance improved when the transport layer is coated from methylene chloride containing a secondary solvent selected from the group consisting of 1,2 dichloroethane, 1,1,2 trichloroethane and mixtures thereof. The fraction of the secondary solvent of 1,2 dichloroethane, 1,1,2 trichloroethane or mixtures thereof must be between about 5 percent and about 30, based on the total weight of all the solvents, i.e. combination of principal and secondary solvents. By employing these solvents the batch to batch variations between the various batches of these polymers in terms of interface trapping is essentially eliminated.

Other layers may also be used such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to enhance resistance to abrasion. In some cases an anticurl back coating may be applied to the side opposite the photoconductive layers to provide flatness and/or abrasion resistance. These overcoating and anticurl back coating layers are well known in the art and may comprise thermoplastic organic polymers or inorganic polymers that are electrically insulating or slightly semiconductive. Overcoatings are continuous and generally have a thickness of less than about 10 micrometers.

The devices employing the combination of generator layer and polymeric transport layer of this invention exhibit numerous advantages such as extremely high sensitivities. Moreover, high sensitivities are maintained during cycling in a machine employing liquid development systems.

This imaging member of the instant invention may be employed in an electrophotographic imaging process comprising: a) providing an electrophotographic imaging member comprising: a supporting substrate; an optional blocking barrier layer; an optional adhesive layer; a charge generating layer comprising particles of a crystalline hydroxygallium phthalocyanine compound represented by the aforementioned formula dispersed in a film forming binder wherein the binder is optionally a charge transporting polymer; and a charge transport layer, the charge transport layer comprising a film forming charge transporting polymer. The charge transporting polymer has a backbone comprising active arylamine moieties along which charge is transported. The charge transport layer is formed on the charge generating layer by applying a coating comprising the charge transporting polymer dissolved in principal methylene chloride solvent and a secondary solvent selected from the group consisting of 1,2 dichloroethane, 1,1,2 trichloroethane or mixtures thereof followed by drying of the coating to form the charge transporting layer. The resulting electrophotographic imaging member can be utilized in a conventional electrophotographic imaging process which includes the steps of depositing a uniform electrostatic charge on the imaging member; exposing the imaging member to activating radiation in image configuration to form an electrostatic latent image on the imaging member; developing the electrostatic latent image with electrostatically attractable marking particles to form a toner image; transferring the toner image to a receiving member; cleaning the imaging member; and repeating the depositing, exposing, developing, transferring, and cleaning steps.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Several generator layers containing vanadyl phthalocyanine pigment particles were prepared by forming coatings using conventional coating techniques on a substrate comprising vacuum deposited titanium layer on a polyethylene terephthalate film (Melinex®, available from ICI). The first coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, followed by curing for 10 minutes at 110 degrees centigrade in a forced air oven. The second coating was an adhesive layer of polyester resin (49,000, available from E. I. dupont de Nemours & Co.) having a thickness of 0.005 micrometer (50 Angstroms) and was coated as follows: 0.5 gram of 49,000 polyester resin was dissolved in 70 grams of tetrahydrofuran and 29.5 grams of cyclohexanone. The film was coated by a 0.5 mil bar and cured in a forced air oven for 10 minutes. The next coating is a charge generator layer containing 35 percent by weight vanadyl phthalocyanine particles, obtained by the process as disclosed in U.S. Pat. No. 4,771,133, dispersed in a polyester resin (Vitel PE100, available from Goodyear Tire and Rubber Co.) having a thickness of 1 micrometer.

EXAMPLE II

Several generator layers containing hydroxygallium phthalocyanine pigment particles were prepared by forming coatings using conventional coating techniques on a substrate comprising vacuum deposited titanium layer on a polyethylene terephthalate film (Melinex®, available from ICI). The first coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, followed by curing for 10 minutes at 110 degrees centigrade in a forced air oven. The second coating was an adhesive layer of polyester resin (49,000, available from E. I. dupont de Nemours & Co.) having a thickness of 0.005 micrometers (50 Angstroms) and was coated as follows: 0.5 grams of 49,000 polyester resin was dissolved in 70 grams of tetrahydrofuran and 29.5 grams of cyclohexanone. The film was coated by a 0.5 mil bar and cured in a forced air oven for 10 minutes. The adhesive interface layer is thereafter coated with a photogenerating layer containing 40 percent by volume hydroxygallium phthalocyanine and 60 percent by volume of a block copolymer of styrene (82 percent)/4-vinyl pyridine (18 percent) having a Mw of 11,900. This photogenerating coating composition is prepared by dissolving 1.5 grams of the block copolymer of styrene/4-vinyl pyridine in 42 ml of toluene. To this solution is added 1.33 grams of hydroxygallium phthalocyanine and 300 grams of ⅛ inch diameter stainless steel shot. This mixture is then placed on a ball mill for 20 hours. The resulting slurry is thereafter applied to the adhesive layer with a Bird applicator to form a layer having a wet thickness of 0.25 mil. This layer is dried at 135° C. for 5 minutes in a forced air oven to form a photogenerating layer having a dry thickness 0.4 micrometer.

EXAMPLE III

Transport layers of monomeric diamine were coated on (a) both generator layers of vanadyl phthalocyanine of Example 1 and (b) the generator layer of hydroxygallium phthalocyanine of Example II. Transport layers are formed by using a Bird coating applicator to apply a solution containing one gram of N,N'-diphenyl-N,N'-bis(3-methylphenyl)-(1,1'biphenyl)-4,4'-diamine and one gram of polycarbonate resin [poly(4,4'-isopropylidene-diphenylene carbonate (available as Makrolon® from Farbenfabricken Bayer A. G.) dissolved in 11.5 grams of methylene chloride solvent. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. The coated device is dried at 80° C. for half an hour in a forced air oven to form a dry 25 micrometer thick charge transport layer

EXAMPLE IV

Transport layers of charge transporting polymer were coated on (a) both generator layers of vanadyl phthalocyanine of Example I and (b) the generator layer of hydroxygallium phthalocyanine of Example II. It was coated with a solution containing one gram of charge transport polyether carbonate resin (Polymer A) dissolved in 11.5 grams of methylene chloride solvent using a 4 mil Bird coating applicator. The polyether carbonate resin was prepared as described in Example III of U.S. Pat. No. Patent 4,806,443. This polyether carbonate resin is an electrically active charge transporting film forming binder and can be represented by the formula:

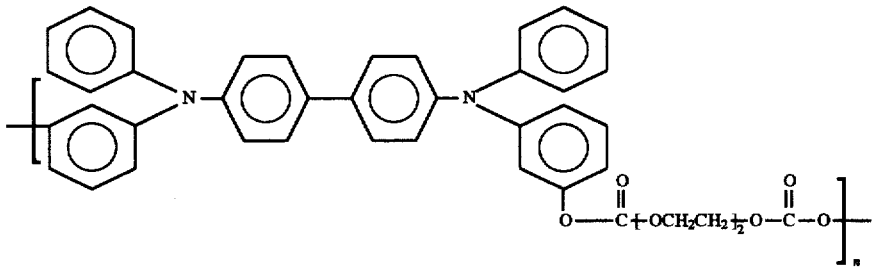

wherein n is about 300 in the above formula so that the molecular weight of the polymer is about 210,000. The film was dried in a forced air oven at 100° C. for 20 minutes.

EXAMPLE V

Transport layers of the polyether carbonate charge transporting polymer were coated on (a) both generator layers of vanadyl phthalocyanine of Example I and (b) generator layer of hydroxygallium phthalocyanine of Example II. Each layer was coated with a solution containing one gram of charge transport polyether carbonate resin (Polymer B) dissolved in 11.5 grams of methylene chloride solvent using a 4 mil Bird coating applicator. Polymer B has the same chemical structure as Polymer A of Example IV, except that it was prepared by a scaled up version of the process described in Example IV and has a weight average molecular weight of 108,000. The films were dried in a forced air oven at 100° C. for 20 minutes.

EXAMPLE VI

The six devices of Examples III, IV and V were mounted on a cylindrical aluminum drum which was rotated on a shaft. The films were charged by a corotron mounted along the circumference of the drum. The surface potentials were measured as a function of time by several capacitively coupled probes placed at different locations around the shaft. The probes were calibrated by applying known potentials to the drum substrate. The films on the drum were exposed and erased by light sources located at appropriate positions around the drum. The measurement consisted of charging the photoconductor device in a constant current or voltage mode. As the drum rotated, the initial charging potential was measured by probe 1. Further rotation led to the exposure station, where the photoconductor device was exposed to monochromatic radiation of known intensity. The surface potential after exposure was measured by probes 2 and 3.

The device was finally exposed to an erase lamp of appropriate intensity and any residual potential was measured by probe 4. The process was repeated with the magnitude of the exposure automatically changed during the next cycle. A photo induced discharge characteristics curve was obtained by plotting the potentials at probes 2 and 3 as a function of exposure. The devices were cycled continuously for 10,000 cycles of charge, expose and erase steps. The vanadyl phthalocyanine (VOPc) devices containing transport layers of diamine and both batches of polyether carbonate had essentially no residual cycle-up. With hydroxy gallium phthalocyanine (OHGaPc) devices however, transport layers of diamine and one batch of polyether carbonate (Polymer A) had essentially no cycle-up. However, polyether carbonate (Polymer B) resulted in a cycle-up of 70 volts. The residual cycle-up for the six samples is shown in Table 1.

TABLE 1

| Sample # | Pigment | Transport Layer | TL solvent | Residual Cycle-up |
|---|---|---|---|---|
| III a | VOPc | Diamine | $CH_2Cl_2$ | <5 V |
| III b | OHGaPc | Diamine | $CH_2Cl_2$ | <5 V |
| IV a | VOPc | Polymer A | $CH_2Cl_2$ | <5 V |
| IV b | OHGaPc | Polymer A | $CH_2Cl_2$ | <5 V |
| V a | VOPc | Polymer B | $CH_2Cl_2$ | <5 V |
| V b | OHGaPc | Polymer B | $CH_2Cl_2$ | 70 V |

EXAMPLE VII

Transport layers of monomeric diamine were coated on (a) both generator layers of vanadyl phthalocyanine of Example I and (b) generator layers of hydroxygallium phthalocyanine of Example II. Each transport layer is formed by using a 4 mil Bird coating applicator to apply a solution containing one gram of N,N'-diphenyl-N,N'-bis(3-methyl-phenyl)-(1,1'biphenyl)-4,4'-diamine and one gram of polycarbonate resin [poly(4,4'-isopropylidene-diphenylene carbonate (available as Makrolon® from Farbenfabricken Bayer A. G.) dissolved in 10.3 grams of methylene chloride and 1.2 grams of 1,1,2 trichloroethane solvent. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. The coated device is dried at 80° C. for half an hour in a forced air oven to form a dry 25 micrometer thick charge transport layer.

EXAMPLE VIII

Transport layers of the charge transporting polymer were coated on (a) both generator layers of vanadyl phthalocyanine of Example I and (b) generator layer of hydroxygallium phthalocyanine of Example II. They were coated with a solution containing one gram of charge transport polyether carbonate resin (Polymer A) dissolved in 10.3 grams of methylene chloride and 1.2 grams of trichloroethane solvent using a 4 mil Bird coating applicator. The layers were dried in a forced air oven at 100° C. for 20 minutes.

EXAMPLE IX

Transport layers of the polyether carbonate charge transporting polymer were coated on (a) both generator layers of vanadyl phthalocyanine of Example I and (b) generator layer of hydroxygallium phthalocyanine of Example II. They were coated with a solution containing one gram of charge transport polyether carbonate resin (Polymer B) dissolved in 10.3 grams of methylene chloride and 1.2 grams of 1,1,2 trichloroethane solvent using a 4 mil Bird coating applicator. The films were dried in a forced air oven at 100° C. for 20 minutes.

EXAMPLE X

Transport layers of the polyether carbonate charge transporting polymer were coated on (a) both generator layers of vanadyl phthalocyanine (VOPc) of Example I and (b) generator layer of hydroxygallium phthalocyanine (OHGaPc) of Example II. They were coated with a solution containing one gram of charge transport polyether carbonate resin (Polymer B) dissolved in 10.3 grams of methylene chloride ($CH_2Cl_2$) and 1.2 grams of 1,2 dichloroethane (1,2 DCE) solvent using a 4 mil Bird coating applicator. The films were dried in a forced air oven at 100° C. for 20 minutes.

EXAMPLE XI

The eight devices from Examples VII, VIII, IX and X were measured as per the procedure described in EXAMPLE VI and the residual cycle-up tabulated in Table 2. The cycle-up seen with polyether carbonate (Polymer B) on OHGaPc was eliminated.

TABLE 2

| Device # | Pigment | Transport Layer | TL solvent | Residual cycle-up |
|---|---|---|---|---|
| VII a | VOPc | diamine | 0.9 $CH_2Cl_2$ + 0.1 1,1,2 TCE | <5 V |
| VII b | OHGaPc | diamine | 0.9 $CH_2Cl_2$ + 0.1 1,1,2 TCE | <5 V |
| VIII a | VOPc | Polymer A | 0.9 $CH_2Cl_2$ + 0.1 1,1,2 TCE | <5 V |
| VIII b | OHGaPc | Polymer A | 0.9 $CH_2Cl_2$ + 0.1 1,1,2 TCE | <5 V |
| IX a | VOPc | Polymer B | 0.9 $CH_2Cl_2$ + 0.1 1,1,2 TCE | <5 V |
| IX b | OHGaPc | Polymer B | 0.9 $CH_2Cl_2$ + 0.1 1,1,2 TCE | <5 V |
| X a | VOPc | Polymer B | 0.9 $CH_2Cl_2$ + 0.1 1,2 DCE | <5 V |
| X b | OHGaPc | Polymer B | 0.9 $CH_2Cl_2$ + 0.1 1,2 DCE | <5 V |

EXAMPLE XII

Transport layers of the polyether carbonate (Polymer C) charge transporting polymer were coated on two samples of hydroxygallium phthalocyanine generator layers of Example II. Polymer C has the same chemical structure as Polymer A of Example IV, except that it was prepared by a scaled up version of the process described in Example II and has a weight average molecular weight of 113,000. One sample was coated with a solution containing one gram of charge transport polyether carbonate resin (Polymer C) dissolved in 11.5 grams of methylene chloride solvent using a Bird coating applicator to form Device XII (a) and the second sample was coated with a solution containing one gram of charge transport polyether carbonate resin (Polymer C) dissolved in 10.3 grams of methylene chloride and 1.2 grams of 1,2 dichloroethane solvent using a 4 mil Bird coating applicator to form Device XII (b). The films were dried in a forced air oven at 100° C. for 20 minutes. On testing the devices as per the test described in EXAMPLE VI, Device XII (a) had a cycle-up of 340 volts in 10,000 cycles whereas Device XII (b) had essentially no cycle-up, a dramatic improvement.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for fabricating an electrophotographic imaging member comprising providing a supporting substrate, forming a charge generating layer on said substrate, said charge generating layer comprising hydroxygallium phthalocyanine particles dispersed in a film forming binder, applying a coating composition to said charge generating layer, said coating composition comprising a film forming charge transporting polymer dissolved in methylene chloride and a solvent selected from the group consisting of 1,2 dichloroethane, 1,1,2 trichloroethane or mixtures thereof, said charge transporting polymer having a backbone comprising active arylamine moieties along which charge is transported, and drying the coating to form a charge transporting layer, said hydroxygallium phthalocyanine being represented by the formula:

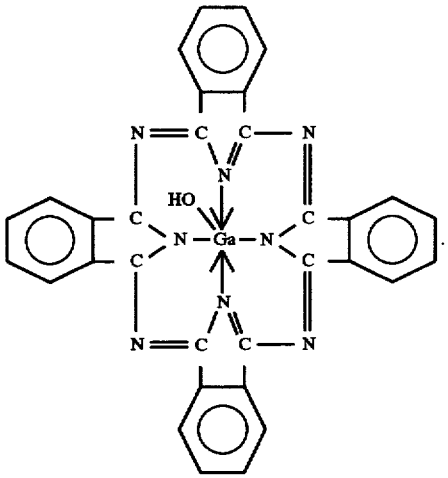

2. A process according to claim 1 wherein said charge transporting polymer is represented by the formula:

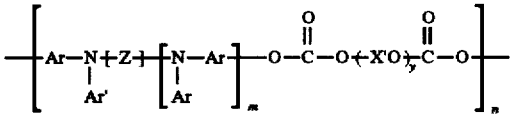

wherein n is between about 5 and about 5,000,

Z is selected from the group consisting of:

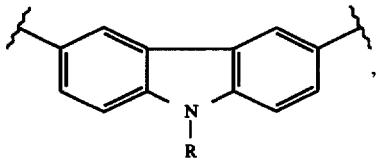

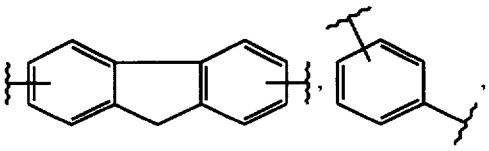

-continued

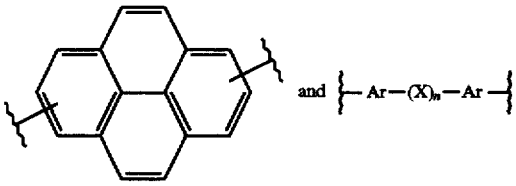

n is 0 or 1,

Ar is selected from the group consisting of:

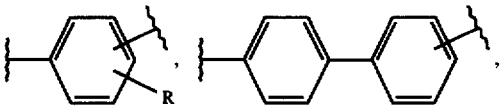

and

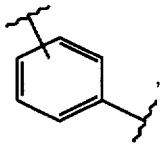

R is an alkyl radical selected from the group consisting of alkyl and iso-alkyl groups containing 2 to 10 carbon atoms, Ar' is selected from the group consisting of:

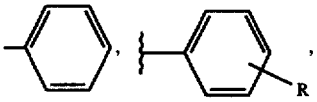

and

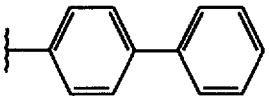

X is selected from the group consisting of:

$-CH_2-$, $-C(CH_3)_2-$, $-O-$, $-S-$,

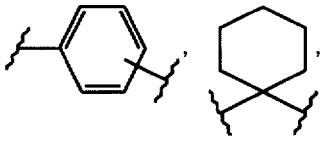

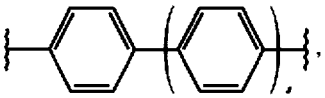

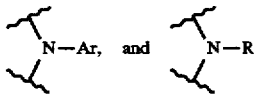

s is 0, 1 or 2, and

X' is an alkyl radical selected from the group consisting of alkyl and iso-alkyl groups containing 2 to 10 carbon atoms.

3. A process according to claim 1 wherein said charge transporting polymer is represented by the formula:

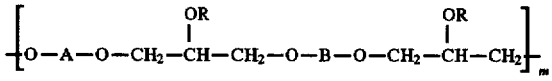

wherein:

R is selected from the group consisting of —H, $—CH_3$, and $—C_2H_5$;

m is between about 4 and about 1,000; and

A is selected from the group consisting of an arylamine group represented by the formula:

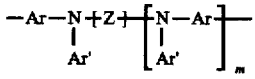

wherein:

m' is 0 or 1,

Z is selected from the group consisting of:

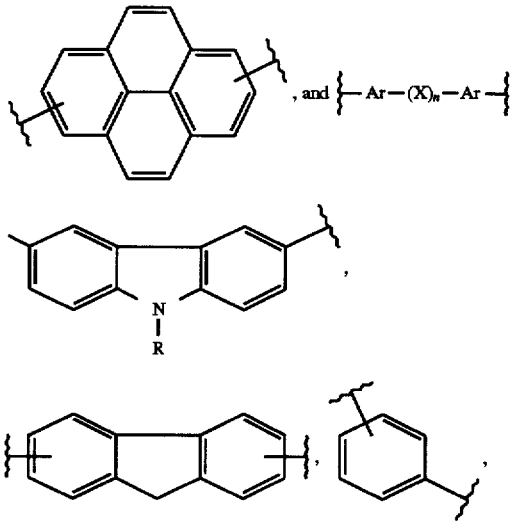

wherein:

n is 0 or 1,

Ar is selected from the group consisting of:

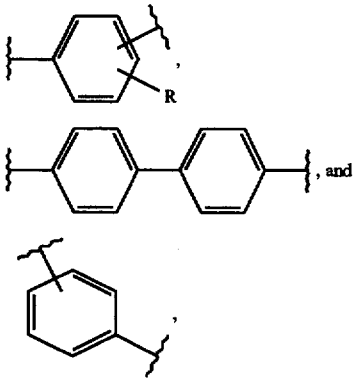

wherein:

R' is selected from the group consisting of $—CH_3$, $—C_2H_5$, $—C_3H_7$, and $—C_4H_9$, Ar' is selected from the group consisting of:

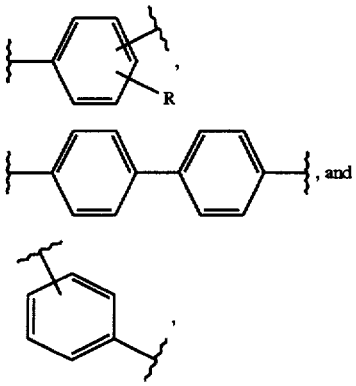

X is selected from the group consisting of:

$—CH_2—$, $—C(CH_3)_2—$, —O—, —S—,

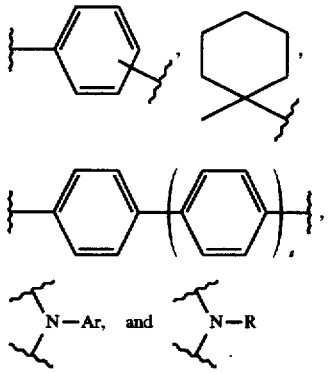

B is selected from the group consisting of:

the arylamine group as defined for A, and $—Ar—(V)_n—Ar—$ wherein

Ar is as defined above, and V is selected from the group consisting of:

$—CH_2—$, $—C(CH_3)_2—$, —O—, —S—,

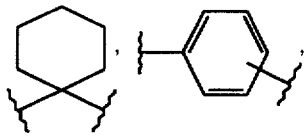

and n is 0 or 1.

4. A process according to claim 1 wherein said charge transporting polymer comprises a charge transporting aromatic amine condensation polymer.

5. A process according to claim 2 wherein said charge transporting polymer is represented by the formula:

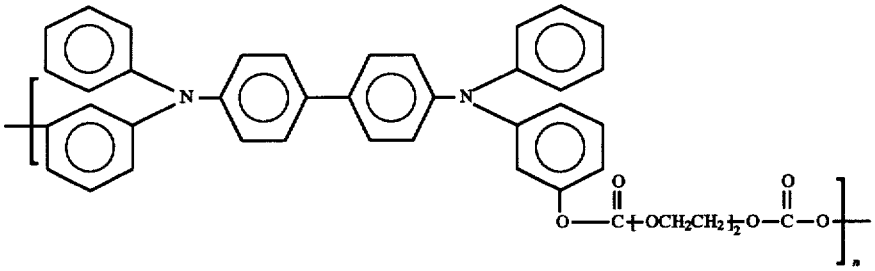

wherein n is between about 10 and about 1,000.

6. A process according to claim 1 wherein said charge transport layer has a thickness of between about 5 micrometers and about 50 micrometers.

7. A process according to claim 1 wherein said charge generating layer comprises an organic photogenerating phthalocyanine pigment dispersed in a film forming binder in an amount of from about 10 percent by volume to about 90 percent by volume of said photogenerating pigment dispersed in about 90 percent by volume to about 10 percent by volume of said film forming binder.

8. A process according to claim 7 wherein said film forming binder comprises a polystyrene/polyvinyl pyridine block copolymer represented by the formula:

$$[\text{polystyrene}]_m/[\text{polyvinyl pyridine}]_n$$

wherein n can be a number between about 7 and about 50, m is a number between about 70 and about 800 and said block copolymer has a weight average molecular weight between about 7,000 and about 80,000.

9. A process according to claim 8 wherein said block copolymer is a copolymer formed from styrene and 4-vinyl-pyridine having a copolymer compositional ratio of said 4-vinyl-pyridine to said styrene in the range of between about 5/95 and about 30/70.

10. A process according to claim 1 wherein the proportion of said 1,2 dichloroethane is between 5 and 30 percent, based on the total weight of said methylene chloride, 1,2 dichloroethane and 1,1,2 trichloroethane.

11. A process according to claim 1 wherein the proportion of said 1,1,2 trichloroethane is between 5 and 30 percent, based on the total weight of said methylene chloride, 1,2 dichloroethane and 1,1,2 trichloroethane.

* * * * *